US011633314B2

(12) United States Patent
Cao et al.

(10) Patent No.: US 11,633,314 B2
(45) Date of Patent: Apr. 25, 2023

(54) AUTOMATIC CLEANING METHOD AND CLEANING BED FOR PATIENT OF GATISM

(71) Applicant: Huzhou University, Huzhou (CN)

(72) Inventors: Meijuan Cao, Zhejiang (CN); Binyu Zhao, Zhejiang (CN); Guohe Feng, Zhejiang (CN); Wei Zhang, Zhejiang (CN); Hangsai Wang, Zhejiang (CN); Tong Wu, Zhejiang (CN); Xiaoxia Luo, Zhejiang (CN); Yucai Hong, Zhejiang (CN)

(73) Assignee: Huzhou University, Huzhou (CN)

( * ) Notice: Subject to any disclaimer, the term of this patent is extended or adjusted under 35 U.S.C. 154(b) by 0 days.

(21) Appl. No.: 17/377,673

(22) Filed: Jul. 16, 2021

(65) Prior Publication Data

US 2022/0202635 A1 Jun. 30, 2022

(30) Foreign Application Priority Data

Dec. 24, 2020 (CN) ..... 202011552334.1

(51) Int. Cl.

| | |
|---|---|
| ***A61G 7/02*** | (2006.01) |
| ***A61G 7/10*** | (2006.01) |
| ***A61G 9/02*** | (2006.01) |

(52) U.S. Cl.

CPC ..... *A61G 7/02* (2013.01); *A61G 7/1032* (2013.01); *A61G 7/1034* (2013.01); *A61G 7/1059* (2013.01); *A61G 9/02* (2013.01); *A61G 2203/78* (2013.01)

(58) Field of Classification Search

CPC ..... A61G 7/02; A61G 7/1034; A61G 7/1032; A61G 7/1059; A61G 9/02; A61G 2203/78

See application file for complete search history.

(56) References Cited

FOREIGN PATENT DOCUMENTS

CN 107019607 A * 8/2017

* cited by examiner

*Primary Examiner* — David R Hare
*Assistant Examiner* — Adam C Ortiz
(74) *Attorney, Agent, or Firm* — Myers Wolin, LLC

(57) ABSTRACT

An automatic cleaning method and a cleaning bed for a patient of gatism are provided. The cleaning bed includes a bed body, a bed plate is arranged on the bed body and is provided with a through groove therein, a bed bottom plate is arranged on a lower part of the bed body, a lifting mechanism is arranged on the bed bottom plate and is provided with a soft cushion thereon, a fabric bracket is arranged under the bed plate and is provided with a material roller thereon, a pressing roller bracket is arranged under the bed plate and at one side close to the fabric bracket and is provided with provided with a first pressing roller and a second pressing roller.

10 Claims, 9 Drawing Sheets

AUTOMATIC CLEANING METHOD AND CLEANING BED FOR PATIENT OF GATISM

CROSS REFERENCE TO RELATED APPLICATION

This patent application claims the benefit and priority of Chinese Patent Application No. 202011552334.1, entitled "Automatic Cleaning Method and Cleaning Bed for a Patient of Gatism" filed on Dec. 24, 2020, the disclosure of which is incorporated by reference herein in its entirety as part of the present application.

TECHNICAL FIELD

The present disclosure relates to the field of medical appliances, and in particular to an automatic cleaning method and cleaning bed for a patient of gatism.

BACKGROUND ART

A pathological phenomenon in which excretion of feces and gas cannot be autonomously controlled due to damages to an anus or its related nerves is also known as fecal incontinence or anal incontinence. Patients failure to autonomously control excretion of feces and gas results in frequent wetness of perineum and feces stains on clothes and trousers. When a complete incontinence occurs, the feces may flow out by itself at any time, for example, the feces and mucus outflow from the anus during coughing, walking, crouching and sleeping. In the case of incomplete incontinence, although dry feces can be controlled, watery feces, however, cannot be controlled. When some incontinent patients lying on a hospital bed discharge a large amount of feces, a bed sheet is contaminated, and a whole bed sheet needs to be replaced, which is inconvenient. A urine separation pad which has a good waterproof effect and can prevent dirt from penetrating into the bed sheet is thus provided under the anus of incontinent patients. In view of this, special hospital beds have been designed by designers, for example, a Chinese Utility Model patent with a publication number of CN203408192U discloses a new type of special care hospital bed with comprehensive functions, which belongs to the field of internet of medical things. The hospital bed includes a main hospital bed, a movable bed board, a dirt storage, a humidity sensor, and a buzzer. A hole is opened in a middle of the movable bed board, and the dirt storage is installed under the hole. A signal from the humidity sensor is transmitted to the buzzer after a paralyzed or incontinent patient has discharged dirt. However, these kinds of equipments have some shortcomings that the urine separation pad still needs to be replaced manually, and the patient needs to be turned over when the urine separation pad is being replaced, which is very inconvenient for critically ill patients.

SUMMARY

The embodiments aim to provide an automatic cleaning method and an automatic cleaning bed for a patient of gatism, which can automatically replace a urine separation pad to ensure a cleanness and a tidiness of a bed body, and make a replacement process convenient and quick.

The automatic cleaning method for incontinent patients includes the following steps of:

S1: starting a lifting mechanism to drive a first belt pulley to rotate so that a flat belt rotates to drive a connecting plate and a soft cushion platform to move downward to a first predetermined position, when an urine separation pad on a soft cushion is contaminated and needs to be replaced, ejecting, by a flushing device under a moving plate, clean water to wash an excreting part of the patient; starting a drying device to dry the excreting part washed after the washing is finished; and taking out the urine separation pad on the soft cushion which is contaminated;

S2: installing a roll-shaped urine separation pad material on a material roller under a bed body, clamping one end of the urine separation pad material between a first pressing roller and a second pressing roller; starting a double-shaft cylinder to drive a clamping mechanism to move toward a side of the urine specification pad material, and extending a lifting cylinder to reach a second predetermined position; operating the clamping mechanism such that a clamping motor is started to drive a rotary rod to rotate, so as to move a matching block to a side away from the material roller, which in turn drives clamping claws to move toward each other to clamp and move the urine separation pad material to the side away from the material roller until a new urine separation pad covers the soft cushion;

S3: starting a cutting motor of a cutting mechanism to rotate a screw, so as to move a reciprocating block along a path of a spiral groove of the screw; where the reciprocating block is moved only in a lateral direction due to being limited by the sleeve, so as to realize a cutting of the urine separation pad material by a blade, and the new urine separation pad cut is finally laid flat on the soft cushion;

S4: re-starting the lifting mechanism, resetting the soft cushion covered with the new urine separation pad, and finishing cleaning.

An automatic cleaning bed for implementing the automatic cleaning method for the patient of gatism is provided, which includes the bed body. A bed plate is provided on the bed body and is provided with a through groove therein, a bed bottom plate is arranged below the bed body; and where a lifting mechanism is arranged on the bed bottom plate and is provided with a soft cushion thereon, a fabric bracket is arranged under the bed plate and is provided with a material roller thereon, a pressing roller bracket is arranged under the bed plate and at a side close to the fabric bracket and is provided with a first pressing roller and a second pressing roller; a cutting mechanism is arranged under the bed plate and at a side close to the pressing roller bracket; sliding rails are respectively arranged under bed edges of both sides of the bed body, sliding blocks on both sides of the bed body are respectively embedded on the sliding rails and are provided with a moving plate, a double-shaft cylinder is arranged under the bed plate, an extending end of the double-shaft cylinder is connected with the moving plate, a lifting cylinder is arranged on both sides of a lower part of the moving plate, and a clamping mechanism is fixed under the lifting cylinder.

In some embodiments, the lifting mechanism may comprise a lifting seat fixed on the bed bottom plate, a lifting motor may be arranged at a side of a bottom of the lifting seat, a first pulley may be arranged on an extending end of the lifting motor, a second pulley bracket may be arranged on an upper end of the lifting seat and may be provided with a second pulley the first pulley and the second pulley may be provided with a flat belt, a lifting slide rail may be arranged on a vertical surface of the lifting seat and may be provided with a plurality of lifting slide blocks, a connecting plate may be arranged on the plurality of lifting blocks and may be provided with the soft cushion platform, the soft cushion may be arranged on the soft cushion platform, a clamping block may be arranged at a side of the connecting plate, and one end of the flat belt may be connected with the clamping block.

In some embodiments, a side of the lifting seat may be provided with an auxiliary bracket.

In some embodiments, the cutting mechanism may comprise a cutting bracket fixed under the bed plate, a cutting motor may be provided at a side of the cutting bracket, a screw sleeved with a sleeve may be arranged on the cutting bracket, and one end of the screw may be connected with an extending end of the cutting motor, a moving groove may be arranged in the sleeve and may have a reciprocating block arranged therein one end of the reciprocating block may be clamped into a spiral groove of the screw, and an other end of the reciprocating block may be provided with a blade.

In some embodiments, a limiting plate may be fixed under the cutting bracket and may be provided with a transverse groove, and the other end of the reciprocating block close to the blade may be arranged in the transverse groove.

In some embodiments, the clamping mechanism may comprise a clamping bracket fixed on the lifting cylinder, the clamping motor may be arranged on a side of the clamping bracket, a rotary rod may be arranged on an extending end of the clamping motor and may be fitted with a matching block, a polished rod may be arranged on an other side of the clamping bracket, linear bearings may be respectively arranged at an upper and a lower parts of the polished rod, connecting rods may be arranged between each of the linear bearings and the matching block, and each of the linear bearings may be provided with corresponding one of the clamping claws, on which a clamping plate may be arranged.

In some embodiments, a mechanism box may be arranged under the moving plate, and the flushing device and the drying device may be arranged in the mechanism box.

In some embodiments, the flushing device may comprise a cold water pipe arranged in the mechanism box, one end of the cold water pipe may be provided with a water pipe connector, one end of the water pipe connector may be provided with a switch, one end of the switch may be provided with a hot water pipe, an outlet of the switch may be connected with an outlet pipe, a first through hole may be provided in a side wall of the mechanism box, and one end of the outlet pipe may pass through the first through hole and may extend out of the mechanism box.

In some embodiments, the drying device may comprise a blower fixed at a bottom of the mechanism box, one end of the blower may be connected with an air inlet pipe, an other end of the blower may be connected to a heating box, one end of the heating box may be connected to a suction fan, one end of the suction fan may be connected to an air outlet pipe which may extend out of the mechanism box.

Compared with the related art, the embodiments have the following advantages.

1. The lifting mechanism is arranged on the bed bottom plate of the bed body and is provided with the soft cushion. The fabric bracket is arranged under the bed plate and is provided with the material roller. The pressing roller bracket is arranged at a side close to the fabric bracket under the bed plate and is provided with the first pressing roller and the second pressing roller. The cutting mechanism is arranged under the bed plate and at the side close to the pressing roller bracket. Sliding rails are respectively arranged under bed edges of both sides of the bed body. Sliding blocks on both sides of the bed body are respectively embedded on the sliding rails and are connected with a moving plate. The double-shaft cylinder is arranged under the bed plate. The extending end of the double-shaft cylinder is connected with the moving plate. Lifting cylinder is connected to both sides of the lower part of the moving plate. The clamping mechanism is fixed under the lifting cylinder. In the initial state, a roll-shaped urine separation pad material is arranged on the material roller, one end of the urine separation pad material is pulled out and clamped between the first pressing roller and the second pressing roller. The soft cushion of the lifting mechanism, on which the urine separation pad is arranged, is arranged in the through groove of the bed plate. When the urine separation pad needs to be replaced, the lifting mechanism is activated to drive the soft cushion to move down. A medical staff takes out the urine separation pad on the soft cushion, and then the double-shaft cylinder is activated to drive the clamping mechanism to move to the side of the urine separation pad material, then the lifting cylinder is extended to reach the designated position. Next, the clamping mechanism is activated to clamp the urine separation pad to move to a side away from the material roller and cover the soft cushion, then the cutting mechanism is activated to cut the urine separation pad material , and finally the lifting mechanism is activated to reset the soft cushion , and a replacing process is completed. A whole replacing process is quick and convenient, times of changing bed sheets are reduced, and a working intensity of the medical staffs is greatly reduced.

2. The cutting mechanism includes the cutting bracket fixed under the bed plate. The cutting motor is provided at a side of the cutting bracket. The screw sleeved with a sleeve is arranged on the cutting bracket. One end of the screw is connected with the extending end of the cutting motor. The moving groove is arranged on the sleeve and has a reciprocating block provided therein. One end of the reciprocating block is clamped in the spiral groove of the screw, and the other end of the reciprocating block is provided with the blade. The reciprocating block moves along a path of a spiral line of the screw. Due to being limited by the moving groove on the sleeve, the reciprocating block will not rotate along with the screw, and can only move back and forth in a transverse direction, and a cutting of the urine separation pad material by the blade is realized.

3. The limiting plate is fixed under the cutting bracket and is provided with the transverse groove, and one end of the reciprocating block close to the blade is arranged in the transverse groove for further limiting a movement of the blade to ensure a stability of the movement of the blade.

4. The clamping mechanism includes the clamping bracket fixed on the lifting cylinder. The clamping motor is arranged on a side of the clamping bracket. The rotary rod is arranged on the extending end of the clamping motor and is fitted with a matching block. The polished rod is arranged on a side of the clamping bracket. The linear bearings are respectively arranged at the upper and the lower parts of the polished rod. The connecting rods are arranged between each of the linear bearings and the matching block and each clamping claw is arranged on corresponding one of the linear bearings and is fixed with a clamping plate. The clamping motor is started to rotate the rotary rod, so that the matching block moves toward the side of the clamping motor, thereby driving the clamping claws on the linear bearings to close, thus effectively clamping the urine separation pad to ensure a stability of a pulling process.

5. The mechanism box is arranged under the moving plate, and the flushing device and the drying device are arranged in the mechanism box. After the incontinent patient defecates, filth may remain on the anus of the patient which then can be flushed by the flushing device and dried.

Figure 1:
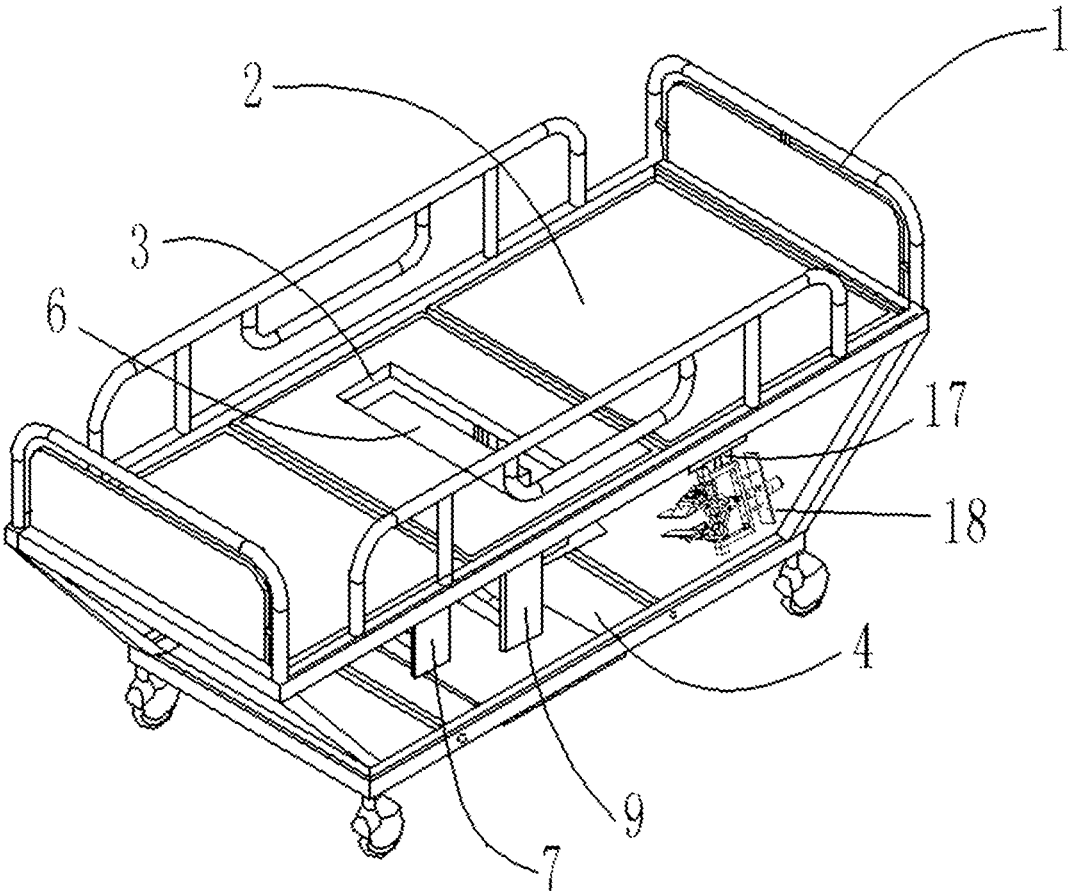
FIG. 1 is a schematic structural diagram of the disclosure.

List of the reference characters: 1 bed body; 2 bed plate; 3 through groove; 4 bed bottom plate; 5 lifting mechanism; 6 soft cushion; 7 fabric bracket; 8 material roller; 9 pressing roller bracket; 10 first pressing roller; 11 second pressing roller; 12 cutting mechanism; 13 sliding rail; 14 sliding block; 15 moving plate; 16 double-shaft cylinder; 17 lifting cylinder; 18 clamping mechanism; 19 mechanism box; 20 flushing device; 21 drying device; 501 lifting seat; 502 lifting motor; 503 first pulley; 504 second pulley bracket; 505 second pulley; 506 flat belt; 507 lifting slide rail; 508 lifting slide block; 509 connecting plate; 510 soft cushion platform; 511 clamping block; 512 auxiliary bracket; 121 cutting bracket; 122 cutting motor; 123 screw; 124 sleeve; 125 moving groove; 126 reciprocating block; 127 blade; 128 limiting plate; 129 transverse groove; 181 clamping bracket; 182 clamping motor; 183 rotary rod; 184 matching block; 185 polished rod; 186 linear bearing; 187 connecting rod; 188 clamping claw; 189 clamping plate; 201 cold water pipe; 202 water pipe connector; 203 switch; 204 hot water pipe; 205 outlet pipe; 206 first through hole; 211 blower; 212 air inlet pipe; 213 heating box; 214 suction fan; and 215 air outlet pipe.

DETAILED DESCRIPTION OF THE EMBODIMENTS

The disclosure is further described below in combination with specific embodiments, but not as a basis for limiting to the disclosure.

An automatic cleaning method for a patient of gatism is provided, which includes the following steps S1-S4. In step S1, the lifting mechanism is started to drive a first belt pulley to rotate so that a flat belt rotates to drive a connecting plate and a soft cushion platform to move downward to a first designated position when an urine separation pad on a soft cushion is contaminated and needs to be replaced. Then, clean water is ejected to wash a excreting part of a patient by a flushing device under a moving plate. A drying device is started to dry the washed part after the washing, and then the urine separation pad on the soft cushion which is contaminated is taken out. In step S2, a roll-shaped urine separation pad material is installed on a material roller under the bed body, one end of the urine separation pad material is clamped between a first pressing roller and a second pressing roller. A double-shaft cylinder is started to drive a clamping mechanism to move toward a side of the urine separation pad material, then a lifting cylinder is extended to reach a second designated position. Subsequently, the clamping mechanism is operated so that a clamping motor starts to drive a rotary rod to rotate, and a matching block moves to a side away from the material roller, and in turn a clamping claws are driven to move toward each other, so as to clamp the urine separation pad material to move to the side away from the material roller until a new urine separation pad covers the soft cushion. In step S3, a cutting motor of a cutting mechanism is started to rotate a screw so that a reciprocating block moves along a path of a spiral groove of the screw. The reciprocating block can only be moved in a lateral direction due to being limited by the sleeve, so as to realize a cutting of the urine separation pad material by a blade and the urine separation pad after being cut is finally laid flat on the soft cushion. In step S4, the lifting mechanism is re-started, the soft cushion covered with a new urine separation pad is reset and the cleaning is finished.

Figure 2:
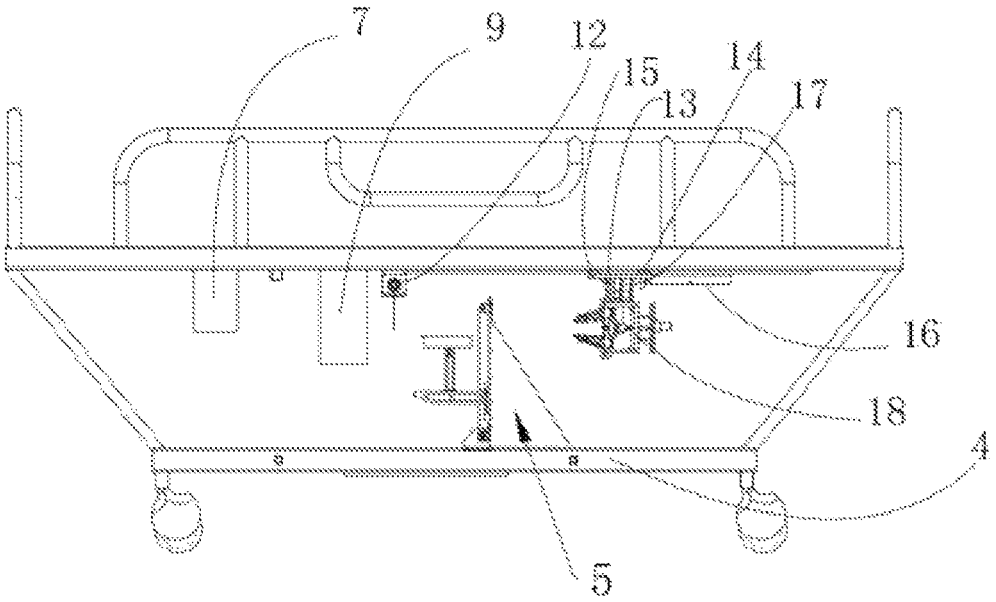
FIG. 2 is a side schematic structural diagram of the disclosure.
Figure 5:
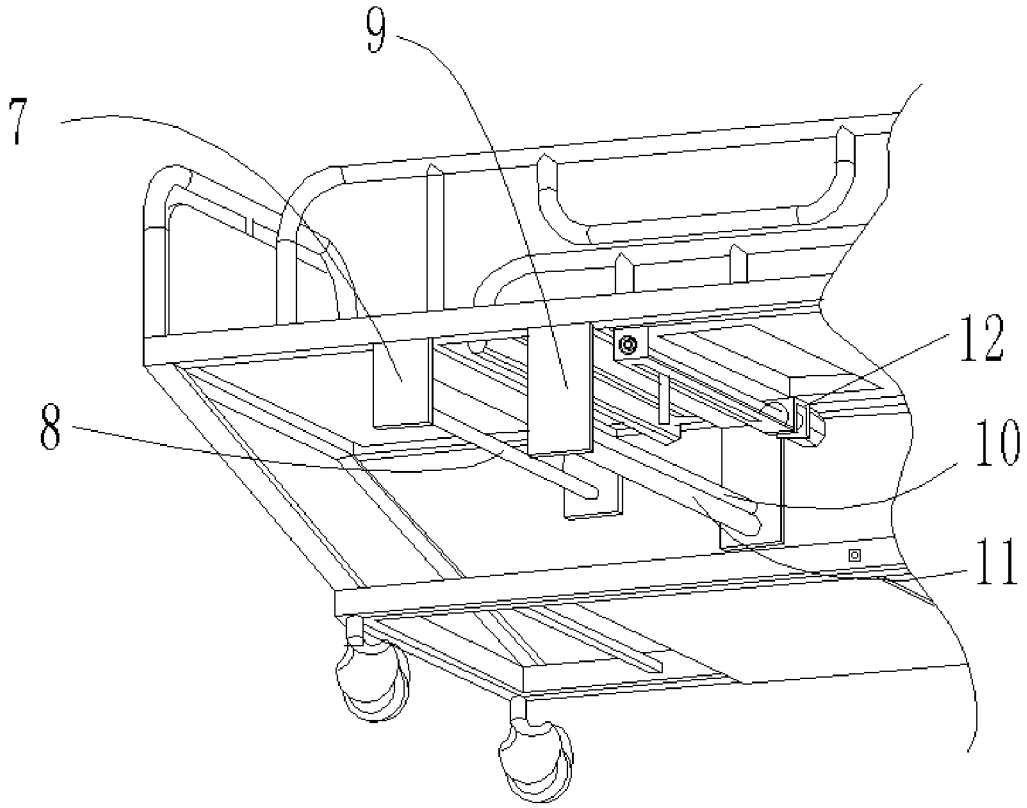
FIG. 5 is a schematic structural diagram of a fabric bracket.

As shown in FIGS. 1 and 2, an automatic cleaning bed for a patient of gatism includes a bed body 1. A bed plate 2 is arranged on the bed body 1. A through groove 3 is arranged on the bed plate 2. A bed bottom plate 4 is arranged below the bed body 1. A lifting mechanism 5 is arranged on the bed bottom plate 4 and is provided with a soft cushion 6 thereon. As shown in FIG. 5, a fabric bracket 7 is arranged under the bed plate 2 and is provided with a material roller 8 thereon, a pressing roller bracket 9 is arranged under the bed plate 2 and at a side close to the fabric bracket 7 and is provided with a first pressing roller 10 and a second pressing roller 11, a cutting mechanism 12 is arranged under the bed plate 2 and at a side close to the pressing roller bracket 9, sliding rails 13 are respectively arranged under bed edges of both sides of the bed body 1, sliding blocks 14 on both sides of the bed body 1 are respectively embedded on the sliding rails 13 and are provided with a moving plate 15, a double-shaft cylinder 16 is arranged under the bed plate 2, an extending end of the double-shaft cylinder 16 is connected with the moving plate 15, a lifting cylinder 17 is arranged on both sides of a lower part of the moving plate 15, and a clamping mechanism 18 is fixed under the lifting cylinder 17. The first pressing roller and the second pressing roller can press one end of the urine separation pad material tightly to maintain a horizontal state of the end of the urine separation pad material, so that the urine separation pad material can be clamped by the clamping mechanism quickly and effectively each time.

Figure 3:
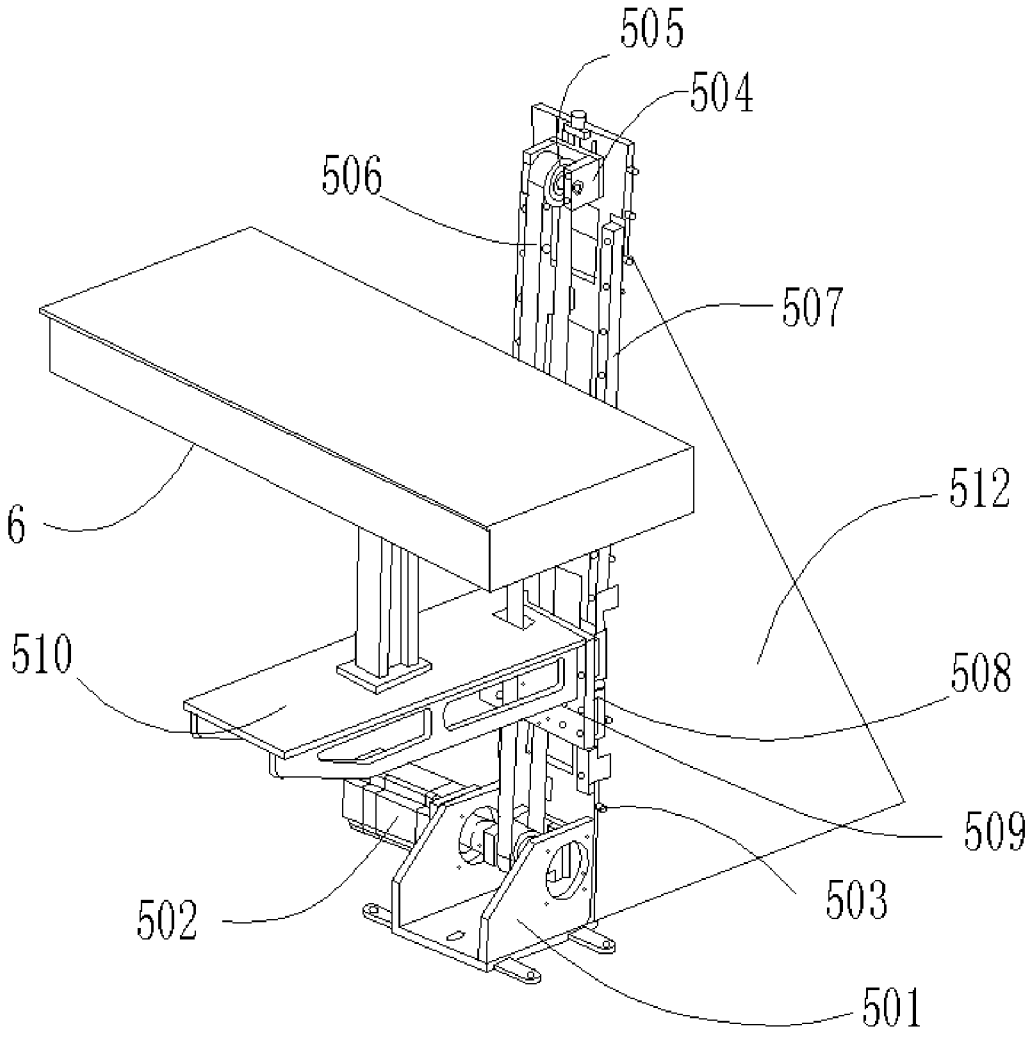
FIG. 3 is a schematic structural diagram of a lifting mechanism.
Figure 4:
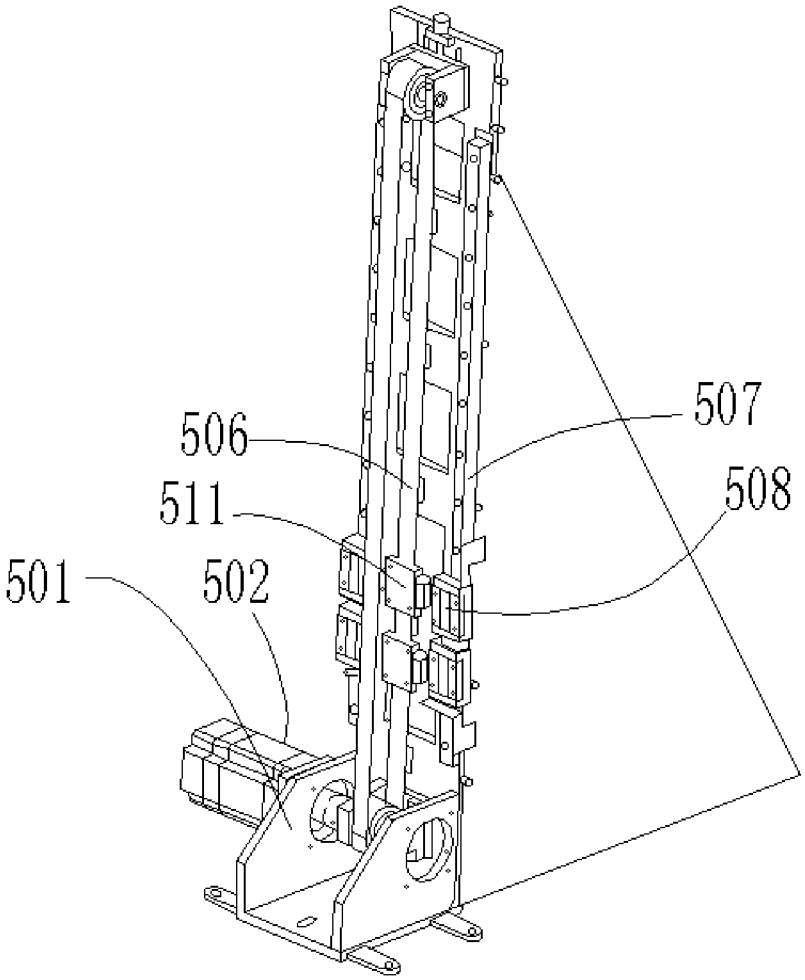
FIG. 4 is a schematic structural diagram of a clamping block.

The lifting mechanism 5 includes a lifting seat 501 fixed on the bed bottom plate 4. As shown in FIGS. 3 and 4, a lifting motor 502 is arranged at a side of a bottom of the lifting seat 501, a first pulley 503 is arranged on an extending end of the lifting motor 502, a second pulley bracket 504 is arranged on an upper end of the lifting seat 501 and is provided with a second pulley 505 the first pulley 503 and the second pulley 505 are provided with a flat belt 506, a lifting slide rail 507 is arranged on a vertical surface of the lifting seat 501 and is provided with a plurality of lifting slide blocks 508, a connecting plate 509 is arranged on the plurality of lifting blocks 508 and is provided with the soft cushion platform510, the soft cushion 6 is arranged on the soft cushion platform 510, a clamping block 511 is arranged at a side of the connecting plate 509, and one end of the flat belt 506 is connected with the clamping block 511. One side of the lifting seat 501 is provided with an auxiliary bracket 512. The auxiliary bracket can increase a stability of the lifting seat to ensure that the lifting mechanism can be stable and effective during lifting. The lifting motor is started to drive the first belt pulley to rotate so that the flat belt rotates to drive the connecting plate and the soft cushion platform to move up and down so as to realize lifting.

Figure 7:
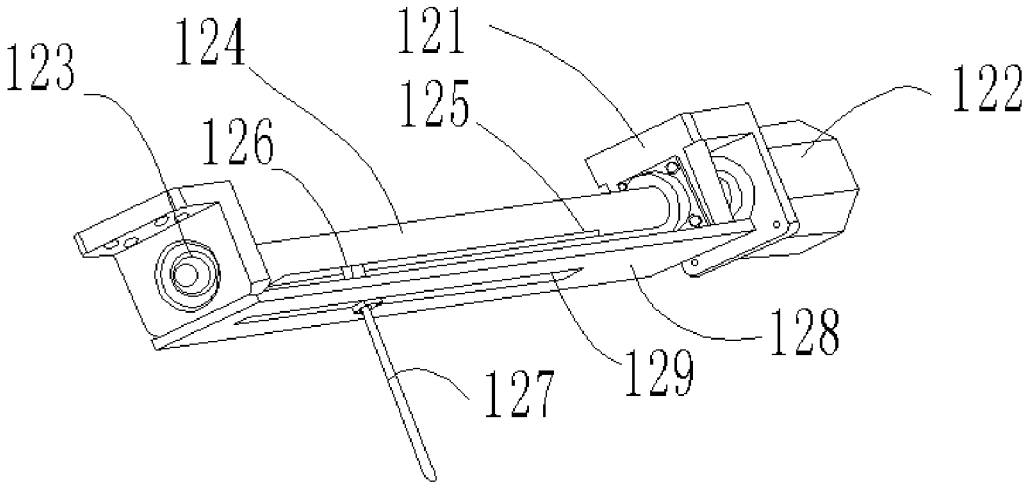
FIG. 7 is a schematic structural diagram of a cutting mechanism.
Figure 8:
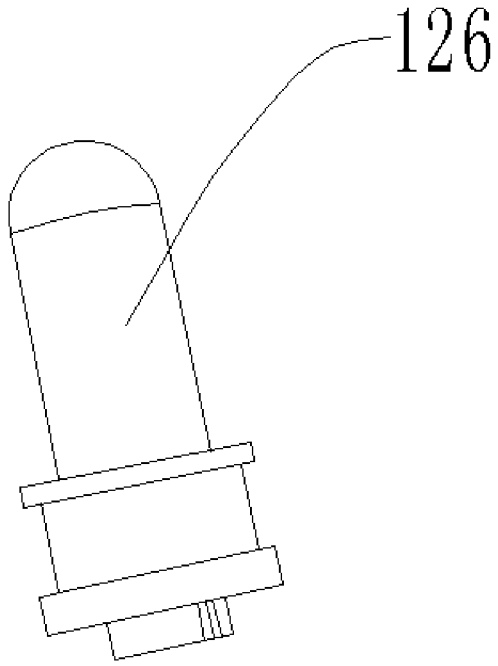
FIG. 8 is a schematic structural diagram of a reciprocating block.

The cutting mechanism 12 includes a cutting bracket 121 fixed under the bed plate 2. As shown in FIGS. 7 and 8, a cutting motor 122 is provided at a side of the cutting bracket 121, a screw 123 sleeved with a sleeve 124 is arranged on the cutting bracket 121, and one end of the screw 123 is connected with an extending end of the cutting motor 122, a moving groove 125 is arranged in the sleeve 124 and has a reciprocating block 126 arranged therein one end of the reciprocating block 126 is clamped into a spiral groove of the screw 123, and an other end of the reciprocating block 126 is provided with a blade 127. The reciprocating block moves along a path of a spiral line of the screw. Due to being limited by the moving groove on the sleeve, the reciprocating block will not rotate along with the screw, and can only move back and forth in a transverse direction, and a cutting of the urine separation pad material by the blade is realized. A limiting plate 128 is fixed under the cutting bracket 121 and is provided with a transverse groove 129, and the other end of the reciprocating block 126 close to the blade 127 is arranged in the transverse groove 129. Further limitation to a movement of the blade ensures a stability of the movement of the blade. The groove on the screw is arc-shaped, and an end of the reciprocating block is spherical shaped.

Figure 6:
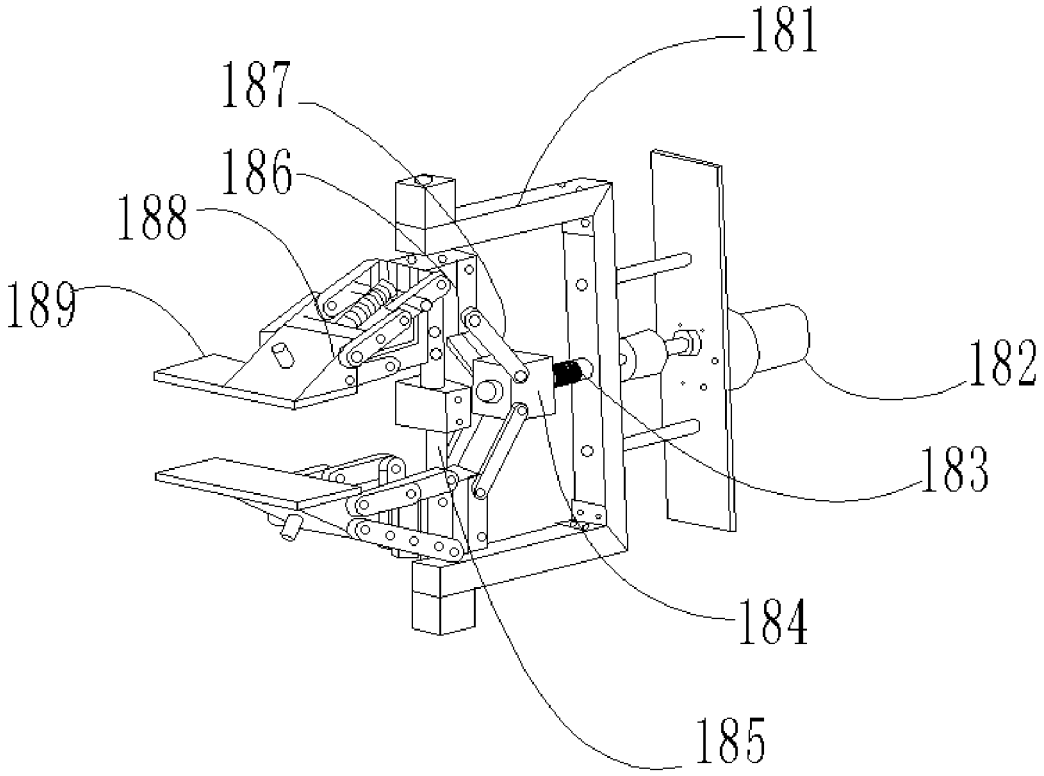
FIG. 6 is a schematic structural diagram of a clamping mechanism.

The clamping mechanism 18 includes a clamping bracket 181 fixed on the lifting cylinder 17. As shown in FIG. 6, a clamping motor 182 is arranged on one side of the clamping bracket 181, a rotary rod 183 is arranged on an extending end of the clamping motor 182 and is fitted with a matching block 184, a polished rod 185 is arranged on an other side of the clamping bracket 181, linear bearings 186 are respectively arranged at an upper and a lower parts of the polished rod 185, connecting rods 187 are arranged between each of the linear bearings 186 and the matching block 184, and each of the linear bearings 186 is provided with corresponding one of the clamping claws 188, on which a clamping plate 189 is arranged.

Figure 9:
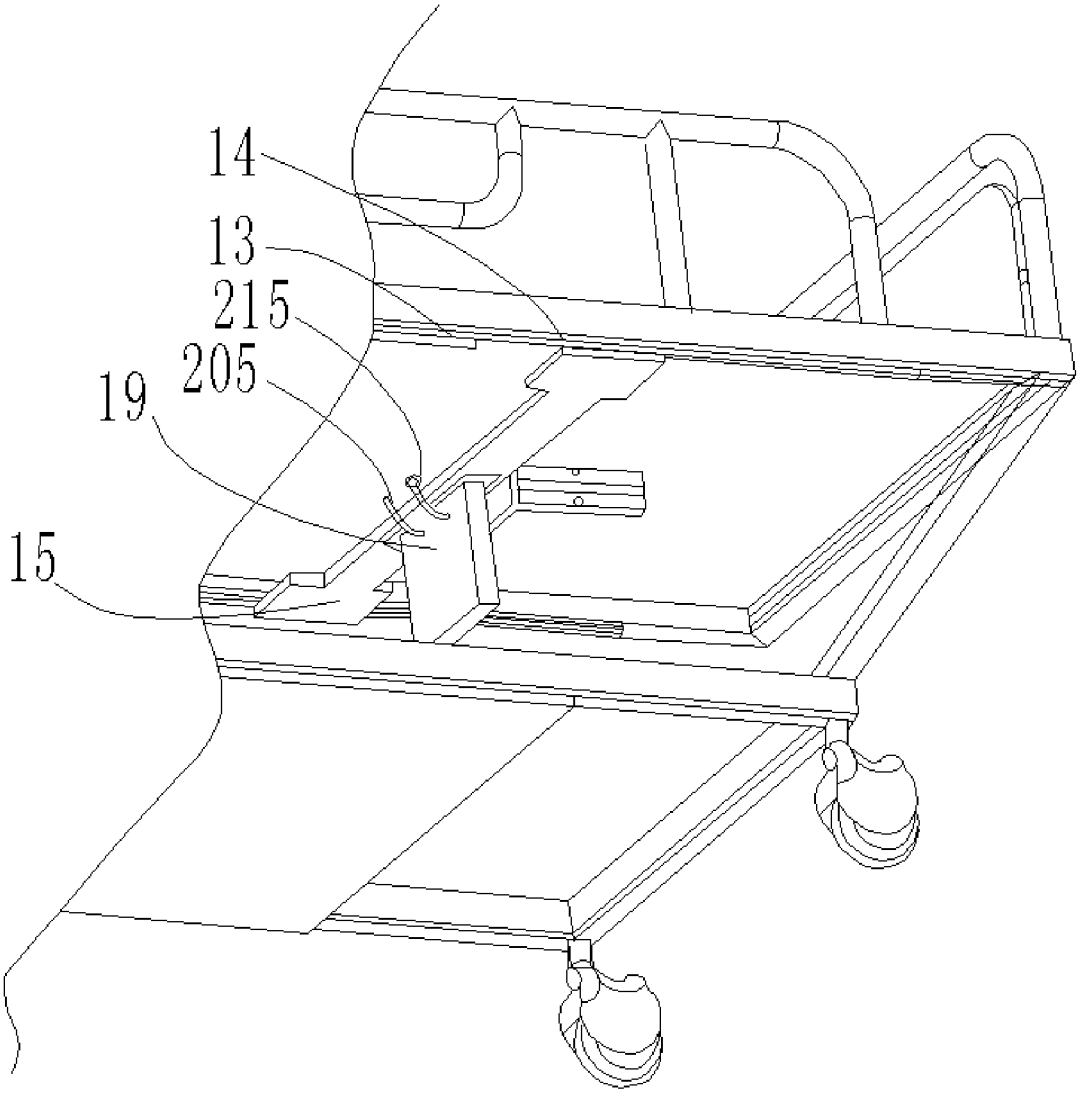
FIG. 9 is a schematic structural diagram of a mechanism box.
Figure 10:
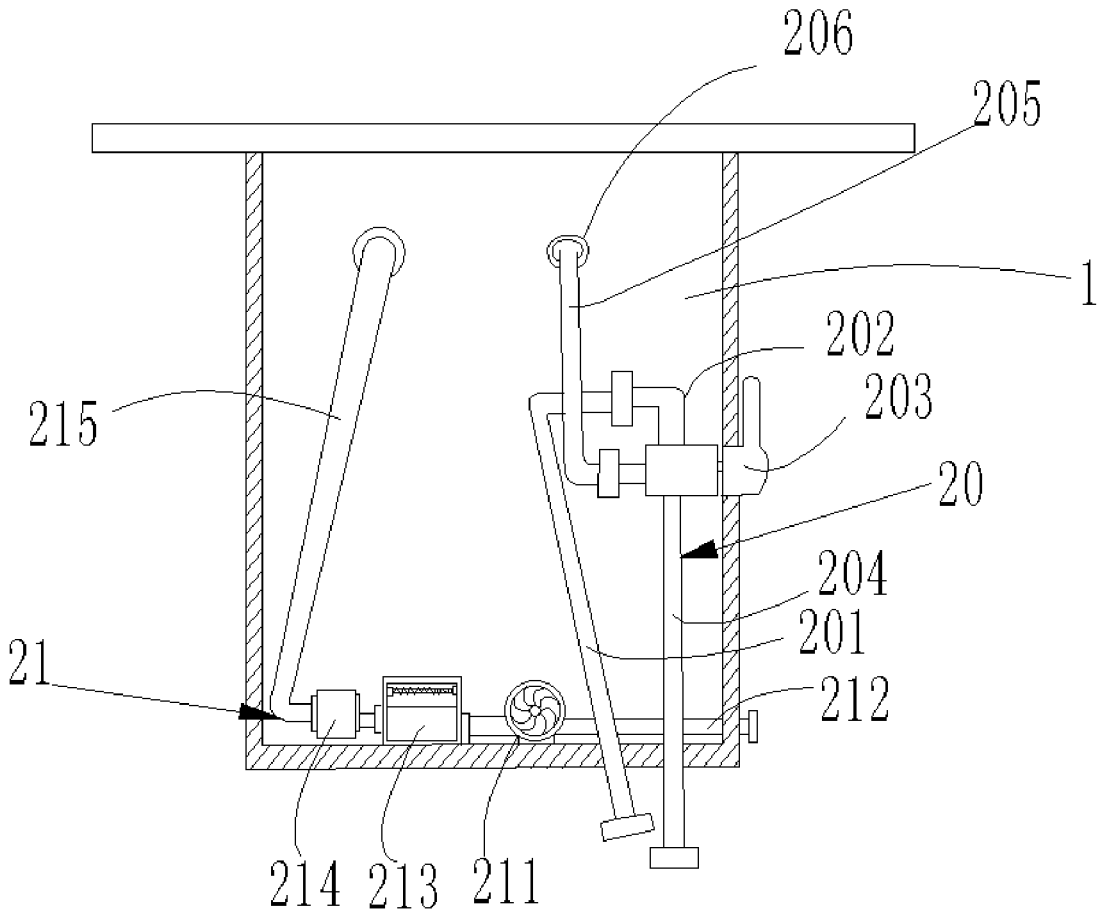
FIG. 10 is a schematic structural diagram of a flushing device.

A mechanism box 19 is arranged under the moving plate 15, and the flushing device 20 and the drying device 21 are arranged in the mechanism box 19. As shown in FIG. 9, the flushing device 20 includes a cold water pipe 201 arranged in the mechanism box 19, as shown in FIG.10, one end of the cold water pipe 201 is provided with a water pipe connector 202, one end of the water pipe connector 202 is provided with a switch 203, one end of the switch 203 is provided with a hot water pipe 204, an outlet of the switch 203 is connected with an outlet pipe 205, a first through hole 206 is provided in a side wall of the mechanism box 19, and one end of the outlet pipe 205 passes through the first through hole 206 and extends out of the mechanism box 19. The cold and hot water pipes extend outward to connect to a water supply, so that the cold and hot water are mixed to obtain water that is gentler, that is, not too cold or too hot, for flushing the patient. The drying device 21 includes a blower 211 fixed at a bottom of the mechanism box 19. One end of the blower 211 is connected with an air inlet pipe 212, and an other end of the blower 211 is connected to the heating box 213. One end of the heating box 213 is connected to a suction fan 214. One end of the suction fan 214 is connected to an air outlet pipe 215. The air outlet pipe 215 extends out of the mechanism box 19. After the incontinent patient defecates, filth may remain on the anus of the patient which then can be flushed by the flushing device and dried.

What is claimed is:

1. An automatic cleaning method for a patient of gatism, comprising:

starting a lifting mechanism to drive a first belt pulley to rotate so that a flat belt rotates to drive a connecting plate and a soft cushion platform to move downward to a first predetermined position, when an urine separation pad on a soft cushion is contaminated and needs to be replaced, ejecting, by a flushing device under a moving plate, clean water to wash an excreting part of the patient; starting a drying device to dry the excreting part washed after the washing is finished; and taking out the urine separation pad on the soft cushion which is contaminated;

installing a roll-shaped urine separation pad material on a material roller under a bed body, clamping one end of the urine separation pad material between a first pressing roller and a second pressing roller; starting a double-shaft cylinder to drive a clamping mechanism to move toward a side of the urine specification pad material, and extending a lifting cylinder to reach a second predetermined position; operating the clamping mechanism such that a clamping motor is started to drive a rotary rod to rotate, so as to move a matching block to a side away from the material roller, which in turn drives clamping claws to move toward each other to clamp and move the urine separation pad material to the side away from the material roller until a new urine separation pad covers the soft cushion;

starting a cutting motor of a cutting mechanism to rotate a screw, so as to move a reciprocating block along a path of a spiral groove of the screw; wherein the reciprocating block is moved only in a lateral direction due to being limited by a sleeve, so as to realize a cutting of the urine separation pad material by a blade, and the new urine separation pad cut is finally laid flat on the soft cushion;

re-starting the lifting mechanism, resetting the soft cushion covered with the new urine separation pad, and finishing cleaning.

2. An automatic cleaning bed for implementing the automatic cleaning method for the patient of gatism of claim 1, comprising the bed body, wherein a bed plate is provided on the bed body and is provided with a through groove therein, a bed bottom plate is arranged below the bed body; and wherein the lifting mechanism is arranged on the bed bottom plate and is provided with the soft cushion thereon, a fabric bracket is arranged under the bed plate and is provided with the material roller thereon, a pressing roller bracket is arranged under the bed plate and at a side close to the fabric bracket and is provided with the first pressing roller and the second pressing roller; the cutting mechanism is arranged under the bed plate and at a side close to the pressing roller bracket; sliding rails are respectively arranged under bed edges of both sides of the bed body, sliding blocks on both sides of the bed body are respectively embedded on the sliding rails and are provided with the moving plate, the double-shaft cylinder is arranged under the bed plate, an extending end of the double-shaft cylinder is connected with the moving plate, the lifting cylinder is arranged on both sides of a lower part of the moving plate, and the clamping mechanism is fixed under the lifting cylinder.

3. The automatic cleaning bed of claim 2, wherein the lifting mechanism comprises a lifting seat fixed on the bed bottom plate, a lifting motor is arranged at a side of a bottom of the lifting seat, a first pulley is arranged on an extending end of the lifting motor, a second pulley bracket is arranged on an upper end of the lifting seat and is provided with a second pulley, the first pulley and the second pulley are provided with the flat belt, a lifting slide rail is arranged on a vertical surface of the lifting seat and is provided with a plurality of lifting slide blocks, the connecting plate is arranged on the plurality of lifting blocks and is provided with the soft cushion platform, the soft cushion is arranged on the soft cushion platform, a clamping block is arranged at a side of the connecting plate, and one end of the flat belt is connected with the clamping block.

4. The automatic cleaning bed of claim 3, wherein a side of the lifting seat is provided with an auxiliary bracket.

5. The automatic cleaning bed of claim 2, wherein the cutting mechanism comprises a cutting bracket fixed under the bed plate, the cutting motor is provided at a side of the cutting bracket, the screw sleeved with the sleeve is arranged on the cutting bracket, and one end of the screw is connected with an extending end of the cutting motor, a moving groove is arranged in the sleeve and has the reciprocating block arranged therein, one end of the reciprocating block is clamped into the spiral groove of the screw, and an other end of the reciprocating block is provided with the blade.

6. The automatic cleaning bed of claim 5, wherein a limiting plate is fixed under the cutting bracket and is provided with a transverse groove, and the other end of the reciprocating block close to the blade is arranged in the transverse groove.

7. The automatic cleaning bed of claim 2, wherein the clamping mechanism comprises a clamping bracket fixed on the lifting cylinder, the clamping motor is arranged on a side of the clamping bracket, the rotary rod is arranged on an extending end of the clamping motor and is fitted with the matching block, a polished rod is arranged on an other side of the clamping bracket, linear bearings are respectively arranged at an upper and a lower parts of the polished rod, connecting rods are arranged between each of the linear bearings and the matching block, and each of the linear bearings is provided with corresponding one of the clamping claws, on which a clamping plate is arranged.

8. The automatic cleaning bed of claim 2, wherein a mechanism box is arranged under the moving plate, and the flushing device and the drying device are arranged in the mechanism box.

9. The automatic cleaning bed of claim 8, wherein the flushing device comprises a cold water pipe arranged in the mechanism box, one end of the cold water pipe is provided with a water pipe connector, one end of the water pipe connector is provided with a switch, one end of the switch is provided with a hot water pipe, an outlet of the switch is connected with an outlet pipe, a first through hole is provided in a side wall of the mechanism box, and one end of the outlet pipe passes through the first through hole and extends out of the mechanism box.

10. The automatic cleaning bed of claim 8, wherein the drying device comprises a blower fixed at a bottom of the mechanism box, one end of the blower is connected with an air inlet pipe, an other end of the blower is connected to a heating box, one end of the heating box is connected to a suction fan, one end of the suction fan is connected to an air outlet pipe which extends out of the mechanism box.

* * * * *